US007480391B2

(12) United States Patent
Kobayashi

(10) Patent No.: US 7,480,391 B2
(45) Date of Patent: Jan. 20, 2009

(54) SPEAKER GASKET AND ITS MANUFACTURING METHOD, AND SPEAKER DEVICE

(75) Inventor: Shinji Kobayashi, Chiba (JP)

(73) Assignee: Sony Corporation, Tokyo (JP)

( * ) Notice: Subject to any disclaimer, the term of this patent is extended or adjusted under 35 U.S.C. 154(b) by 422 days.

(21) Appl. No.: 10/992,626

(22) Filed: Nov. 18, 2004

(65) Prior Publication Data

US 2005/0123154 A1 Jun. 9, 2005

(30) Foreign Application Priority Data

Nov. 18, 2003 (JP) ..... 2003-388591

(51) Int. Cl.
*H04R 25/00* (2006.01)

(52) U.S. Cl. ..... 381/398; 381/432; 381/433

(58) Field of Classification Search ..... 381/395, 381/386, 152, 396, 398, 403, 404, 423, 424, 381/432, 433, 392; 181/295, 171, 172; 29/594, 29/609.1

See application file for complete search history.

(56) References Cited

U.S. PATENT DOCUMENTS

| | | | | |
|---|---|---|---|---|
| 4,661,973 | A | 4/1987 | Takahashi | |
| 5,062,140 | A | 10/1991 | Inanaga et al. | |
| 5,402,503 | A | 3/1995 | Prokisch | |
| 5,461,677 | A | 10/1995 | Raj et al. | |
| 5,687,247 | A * | 11/1997 | Proni | 381/398 |
| 6,269,168 | B1 | 7/2001 | Tagami | |
| 6,567,529 | B1 * | 5/2003 | Roark | 381/423 |
| 6,574,346 | B1 | 6/2003 | Tanaka | |
| 7,025,170 | B2 * | 4/2006 | Lin | 181/171 |
| 7,031,487 | B2 * | 4/2006 | Stiles | 381/398 |
| 2005/0105756 | A1 | 5/2005 | Kobayashi et al. | |
| 2005/0129266 | A1 | 6/2005 | Kobayashi et al. | |

FOREIGN PATENT DOCUMENTS

| | | |
|---|---|---|
| EP | 0581129 A1 | 2/1994 |
| JP | 58-34484 | 3/1983 |
| JP | 59062299 A | 4/1984 |
| JP | 03083496 | 4/1991 |

* cited by examiner

*Primary Examiner*—Huyen D Le
(74) *Attorney, Agent, or Firm*—Wolf, Greenfield & Sacks, P.C.

(57) ABSTRACT

A speaker gasket and its manufacturing method, and a speaker device, the speaker gasket formed by a rectangular sheet with a flat opening of a girth of a prescribed length at the center and capable of significantly reducing the amount of wasteful material in manufacturing, the speaker device offering high reliability.

12 Claims, 5 Drawing Sheets

SPEAKER GASKET AND ITS MANUFACTURING METHOD, AND SPEAKER DEVICE

BACKGROUND OF THE INVENTION

1. Field of the Invention

This invention relates to a speaker gasket and its manufacturing method, and a speaker device, and is suitably applied to a cone speaker, for example.

2. Description of the Related Art

There are some cone speakers constructed as shown in FIG. 1.

Such a cone speaker 1 has a conic cone vibratory plate 2 with its center opened. The outer circumference of the cone vibratory plate 2 is fixed to a frame 4 via an edge 3, and the inner circumference which is the central part of the cone vibratory plate 2 is attached to a damper 5 fixed in the frame 4, thereby the cone vibratory plate 2 can be kept so as to vibrate only forwards (arrow a) and backwards without rolling.

In addition, on the outer circumference of the edge 3, a annular gasket 6 made of rubber or the like is fixed, so that the gasket 6 acts as a buffer when this cone speaker 1 is attached to a speaker box or an internal panel of a vehicle. This can previously and effectively prevent unwanted vibration and generation of noise.

Further, at the inner circumference of the cone vibratory plate 2, a cylindrical voice coil bobbin 8 having wounded thereon a voice coil 7 comprising a lead line is fixed together with the damper 5. In front of the opening 2A at the center of the cone vibratory plate 2, a hemisphere head cap 9 is attached so as to cover the opening 2A, with the result that the head cap 9 can previously prevent deformation of the cone vibratory plate 2 in the diameter direction and also prevent dusts from entering the opening 2A of the cone vibratory plate 2.

On the other hand, on the bottom of the frame 4, a magnetic circuit 10 for vibrating the cone vibratory plate 2 forwards and backwards is fixed. This magnetic circuit 10 has a disk yoke 11 provided with a column pole piece 11A at the center of the top, and a toric magnet 12 is fixed so as to surround the outer circumference of the yoke 11 and a toric plate 13 is laminated and fixed on the magnet 12.

When the magnetic circuit 10 is attached to the frame 4 so that the top of the plate 13 is fixed to the bottom of the frame 5, the voice coil bobbin 8 having the voice coil 7 wounded thereon is kept in a contactless manner in a magnetic gap g formed between the pole piece 11A and the plate 13.

Thus in the cone speaker 1, when electromagnetic force is applied to the voice coil 7 according to applied current based on an audio signal externally supplied, the voice coil 7 and the magnet 12 attract and repel each other, thereby generating a sound wave according to the audio signal by vibrating the cone vibratory plate 2 forwards and backwards.

For a manufacturing method of a gasket 6 used in such cone speaker 1, please refer to Japanese Patent Laid-Open No. 1-256499.

By the way, gaskets 6 used in such a cone speaker 1 are normally produced by cutting a sheet material 21 made of, for example, rubber, having a double stick sheet 20 stuck on its one surface, into rings.

In such the conventional manufacturing method, however, since the sheet material 21 is cut so that ring gaskets 6 have curvature, a ratio of unused parts (wasteful part) to parts which are actually used as the gaskets 6 in the sheet material 21 is large and the wasteful parts are difficult to be recycled and just have to be discarded. That is, the sheet material 21 can not be used effectively.

As one technique to solve such problems, the aforementioned Japanese Patent Laid-Open No. 1-256299 proposes such a technique as to cut a sheet material 21 into a flat deformed ring which is like a pressed gasket, and deform this ring to attach to the frame 4 of a cone speaker 1.

In this technique, since the sheet material 21 is cut into flat deformed rings as the gaskets 6, more number of gaskets 6 can be obtained from the sheet material 21, resulting in reducing wasteful parts of the sheet material 21, as compared with the conventional technique.

This technique, however, cannot cut the sheet material into gaskets 6 without wasting parts because the gaskets 6 made from the sheet material 21 are still flat deformed rings and therefore are made with curvature. As a result, this technique is not sufficient in view of effective use of the sheet material 21.

Further, continuous discarding of wasteful material does not match the current general atmosphere considering global environment, and further the wasteful material should be further reduced.

SUMMARY OF THE INVENTION

This invention has been made in view of foregoing and intends to a speaker gasket and its manufacturing method capable of significantly reducing wasteful material in manufacturing, and a speaker device offering high reliability.

In this invention, to solve the above problems, a speaker gasket is formed in a rectangle sheet with a flat opening of a girth of a prescribed length at the center.

As a result, since the speaker gasket has not curvature, wasteful material remained after cutting a sheet material can be significantly reduced.

Further, in this invention, speaker gaskets are produced by cutting the sheet material made of prescribed material into a plurality of rectangular areas arranged in a matrix in a plane and creating a flat opening of a girth of a prescribed length at the center of each rectangular area.

As a result, with this speaker gasket manufacturing method, wasteful part remained after cutting a sheet material into speaker gaskets can be significantly reduced because the speaker gaskets (rectangular areas) made by cutting the sheet material has no curvature.

Furthermore, in this invention, a speaker device is provided with a gasket formed in a rectangular sheet and having a flat opening of a girth of a prescribed length at the center, and a frame having a gasket holding means formed around its edge opening to hold the gasket. The gasket is deformed and attached along the opening of the frame and the gasket holding means of the frame holds the gasket so as to keep its deformed state.

As a result, this speaker device can effectively prevent the frame from coming off due to stress generated inside by the deformation of the gasket attached to the frame while significantly reducing wasteful parts remained after cutting the sheet material into gaskets.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Preferred embodiments of this invention will be described with reference to the accompanying drawings:

(1) Construction of Cone Speaker According to this Embodiment

Figure 1:
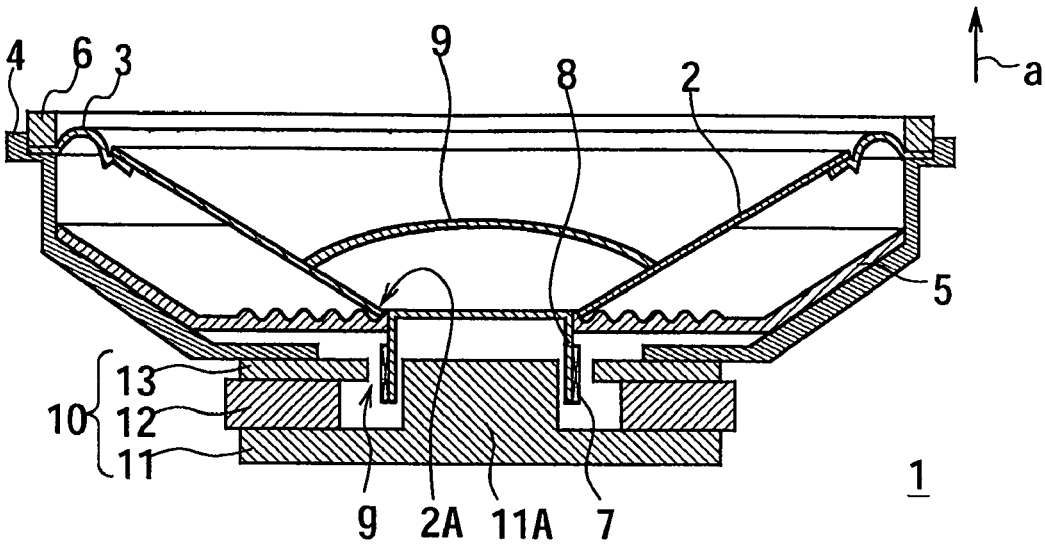
FIG. 1(RELATED ART)
FIG. 1 is a cross-sectional view showing a construction of a conventional cone speaker.
Figure 2:
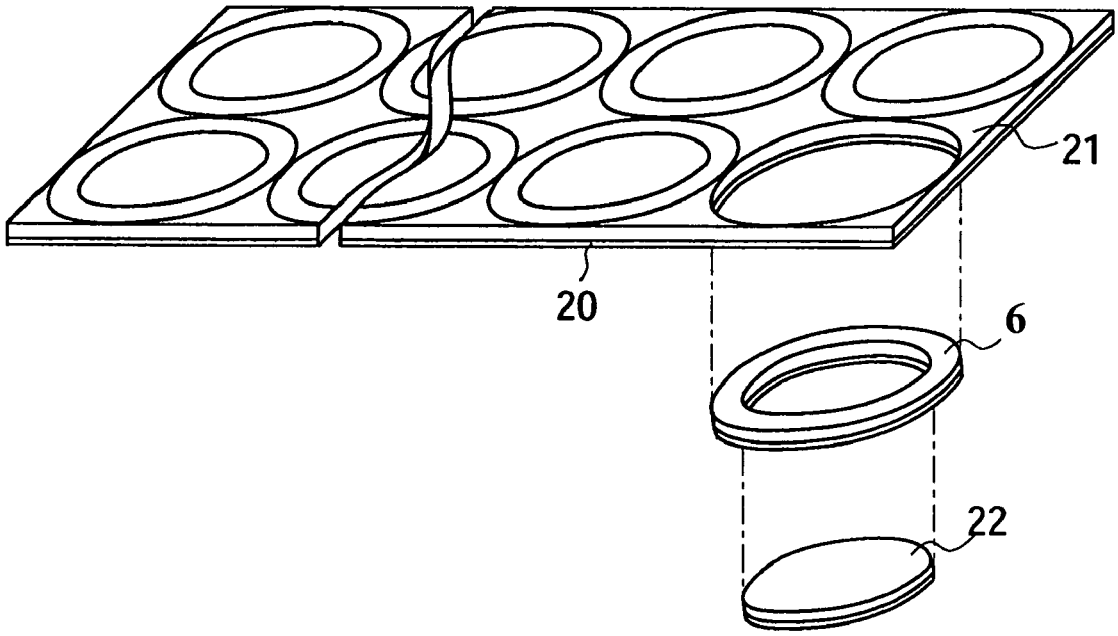
FIG. 2(RELATED ART)
FIG. 2 is a perspective view explaining a conventional manufacturing method of a gasket.
Figure 3:
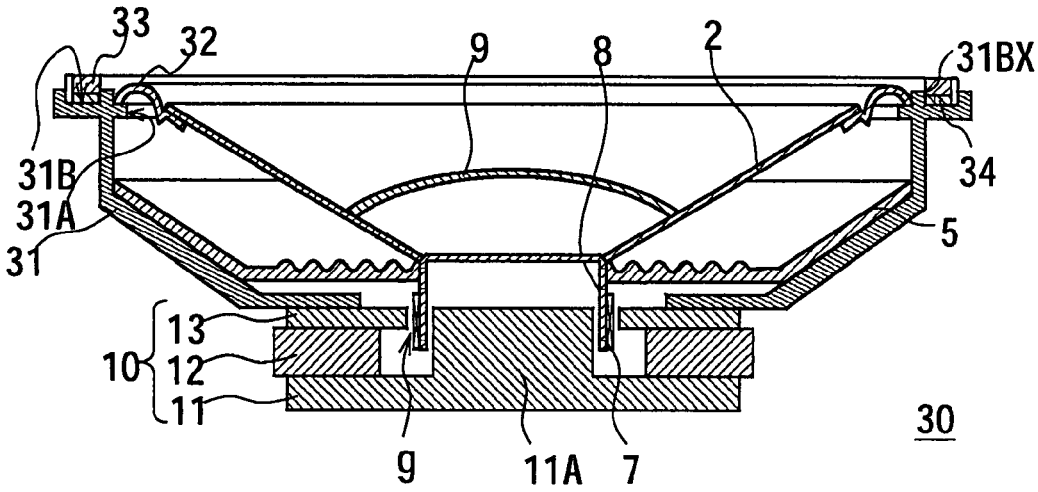
FIG. 3 is a cross sectional view showing a construction of a cone speaker according to this embodiment.

In FIG. 3 where the same reference numerals are applied to parts corresponding to those of FIG. 1, reference numeral 30 shows a cone speaker according to this embodiment. This speaker 30 is identical to the above-described conventional cone speaker 1, excepting for the constructions of a frame 31, an edge 32, and a gasket 33.

In actual, in a case of this cone speaker 30, an annular projection 31A of a prescribed height is formed along a part close to the edge of the inner side of the frame 31. And an edge 32 shaped like the conventional edge 3 (FIG. 1) without its outer circumference part is fixed to the frame 31 by being attached to this projection 31A.

In addition, at the edge forming the edge opening of the frame 31, an annular groove 31B of a prescribed width is formed along the opening. The gasket 33 is attached by being stuck on the double-stick sheet 34 stuck on the bottom of the groove 31B.

Figure 4:
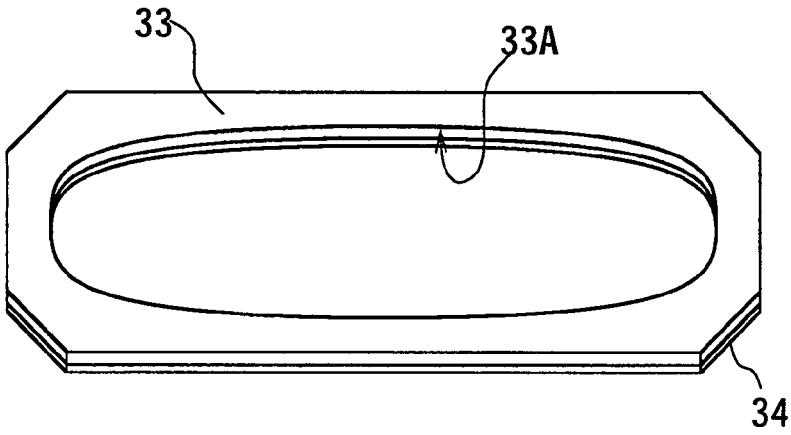
FIG. 4 is a perspective view showing a specific construction of a gasket according to this embodiment.
Figure 5:
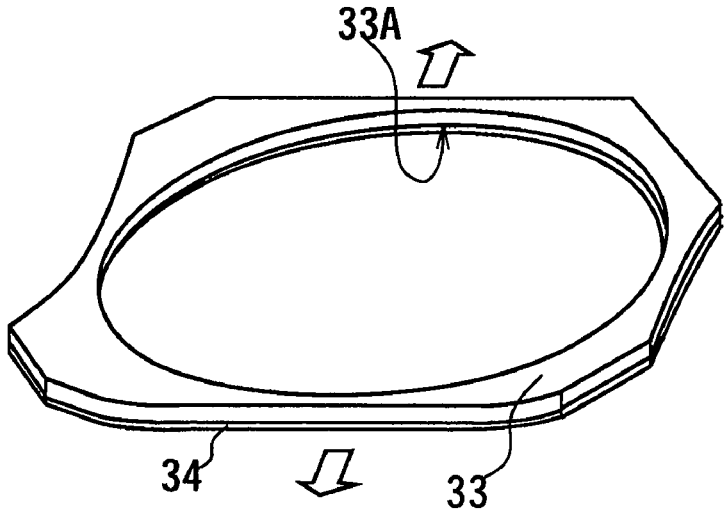
FIG. 5 is a perspective view showing deformation of the gasket.

In this case, as shown in FIG. 4, the gasket 33 is formed in a rectangular sheet with, at the center, a flat opening 33A, such as elliptic opening, of a girth of a prescribed length which is the same or a little shorter than the girth of the inner wall of the groove 31B of the frame 31. Then as shown in FIG. 5, the gasket 33 is stretched in a shorter diameter direction of the opening 33A and is attached by being inserted in the groove 31B of the frame 31.

Figure 6:
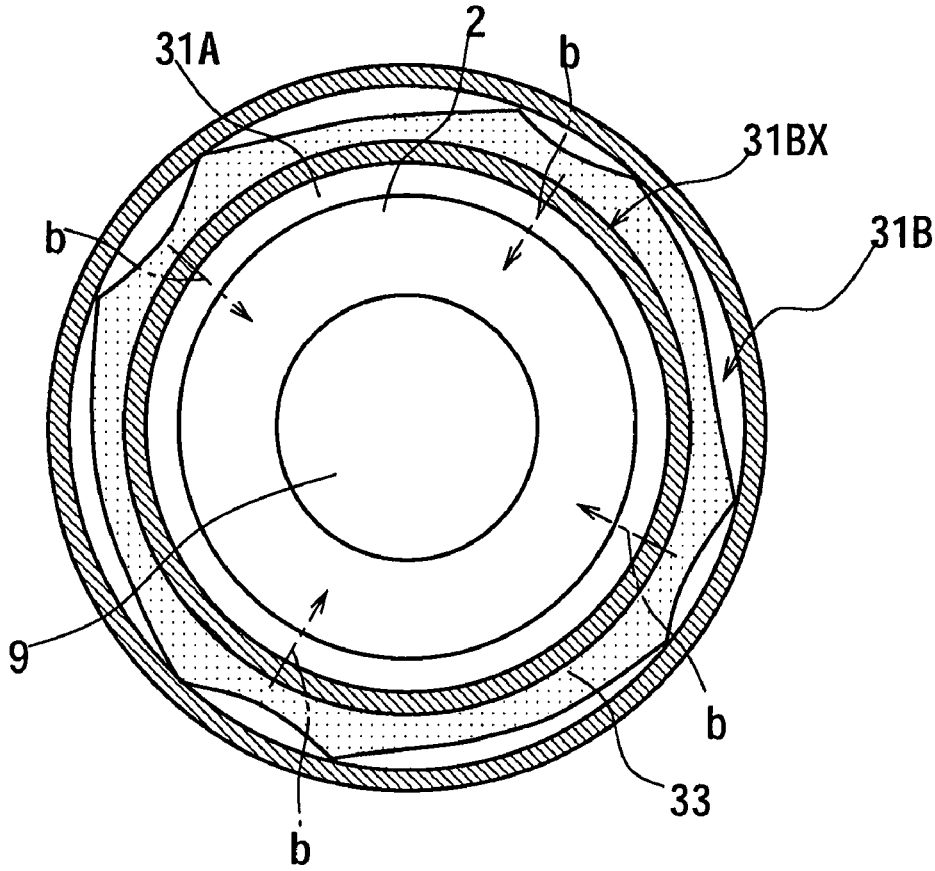
FIG. 6 is a front view explaining stress generated in the deformed gasket.

Thereby, against stress as shown by an arrow b in FIG. 6, which makes the gasket 33 return to the original shape and is generated in the gasket 33 deformed and attached to the frame 31, the cone speaker 30 can keep the gasket 33 in the deformed state by the inner wall 31BX of the groove 31B of the frame 31, thus being capable of previously and effectively preventing the gasket 33 from coming off the frame 31 due to the stress.

In addition, as clear from FIG. 4, the four corners of the gasket 33 are cut off, so that strain in each corner having large loads caused by the deformation can be reduced when the gasket 33 is deformed when inserted in the groove 31B of the frame 31 as described above.

(2) Gasket Manufacturing Procedure According to this Embodiment

The gasket 33 to be used in the cone speaker 30 according to the embodiment can be produced in the following procedure shown in FIGS. 7A to 7C.

Figure 7A:
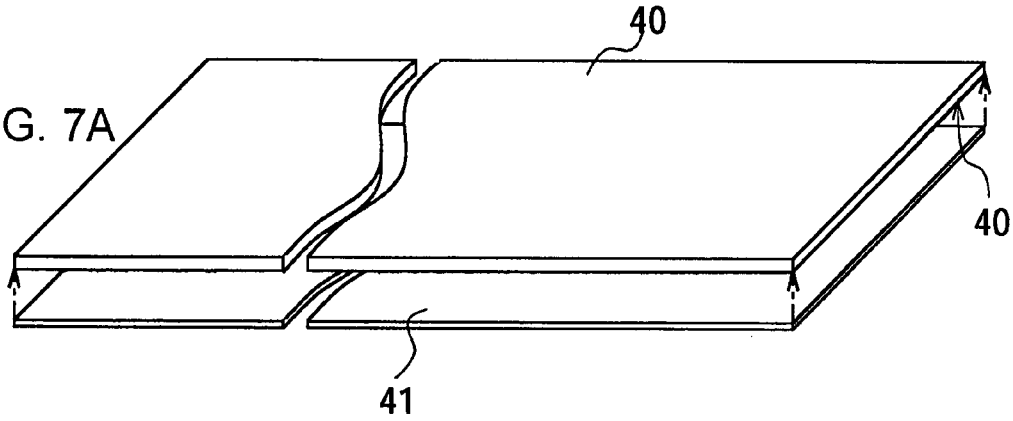
FIGS. 7A to 7C are perspective views explaining a manufacturing procedure of a gasket according to this embodiment.
Figure 7B:
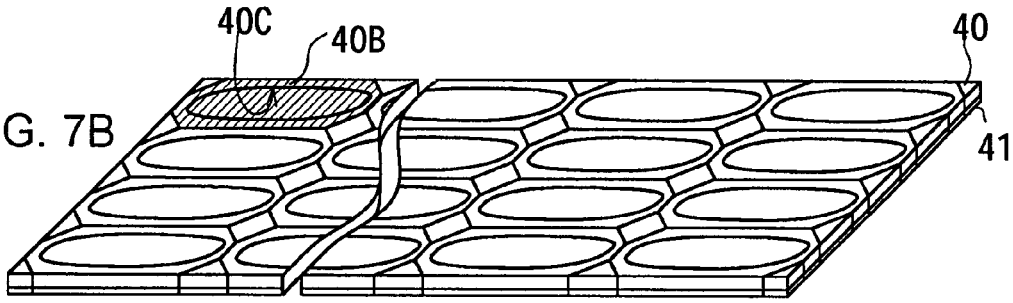

That is, as shown in FIG. 7A, a double-stick sheet 41 is stuck on one surface 40A of the sheet material 40 made of a foam macromolecult material or a deformable and flexible material such as rubber, and then as shown in FIG. 7B, this sheet material 40 is cut into a plurality of rectangular areas 40B (areas shown by an oblique line in FIG. 7B) arranged in a matrix in a plane without gap.

Figure 7C:
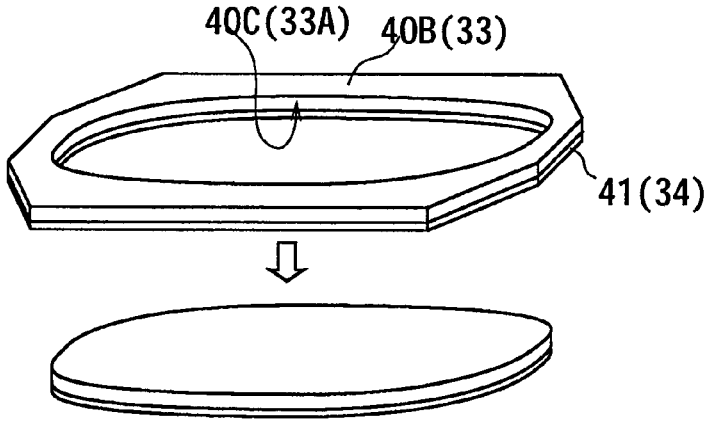

At this time, as shown in FIGS. 7B and 7C, each rectangular area 40B is taken off the sheet material 40 with cutting off the four corners and creating an elliptic opening 40C at the center, so that the rectangular area 40B can be used as a gasket as it is. In this way, the rectangular area 40A can be used as the gasket 33 as described above with reference to FIG. 4.

(3) Operation and Effects of this Invention

In the above configuration, for the cone speaker 30 according to this embodiment, the gaskets 33 are formed in a rectangular shape, so that the gaskets 33 can be produced by cutting the sheet material 40 into a plurality of rectangular areas 40B arranged in a matrix in a plane without gap.

Therefore, since each gasket 33 used in the cone speaker 30 according to this embodiment has no curvature, the sheet material 40 can be used effectively in manufacturing because parts other than the four corners and the inside of the openings 40C of the rectangular areas 40B are used as gaskets.

Thus, since the gasket 33 is formed in such a shape, as compared with a conventional case, the amount of wasteful material can be significantly reduced (to about 50%), resulting in creating more number of gaskets from one sheet material 40.

Further, in the cone speaker 30 according to this embodiment, a gasket made in the above described manner is deformed and attached to the frame 31 by being inserted in the groove 31B formed on the edge of the frame 31. Therefore, the stress which makes the gasket 33 return to the original shape and is generated in the gasket 33 by this deformation is supported by the inner wall 31BX of the groove 31B, thereby previously and effectively preventing the gasket 33 from coming off the frame 31.

According to the above configuration, the gasket 33 is formed in a rectangular shape, so that wasteful parts remained after cutting the sheet material 40 into gaskets 33 can be significantly reduced, thus making it possible to realize a gasket capable of significantly reducing the amount of wasteful material in manufacturing.

Furthermore, the groove 31B is provided at the edge of the frame 31 and the gasket 33 is attached to the frame 31 by being inserted in the groove 31B. This can effectively prevent the gasket 33 from coming off the frame 31, thus making it possible to make a cone speaker offering high reliability.

(4) Other Embodiments

Note that the above embodiment has described a case where this invention is applied to an external magnet type cone speaker 1. This invention, however, is not limited to this and can be widely applied to speaker devices of other types, including inner magnet type cone speakers.

Further, the above embodiment has described a case where the shape of the opening 33A formed at the center of the gasket 33 is elliptic. This invention, however, is not limited to this and the opening 33A have various shapes, provided that the opening is a flat opening of which the girth is the same or a little shorter than that of the inner wall of the groove 31B of the frame 31.

Figure 8:
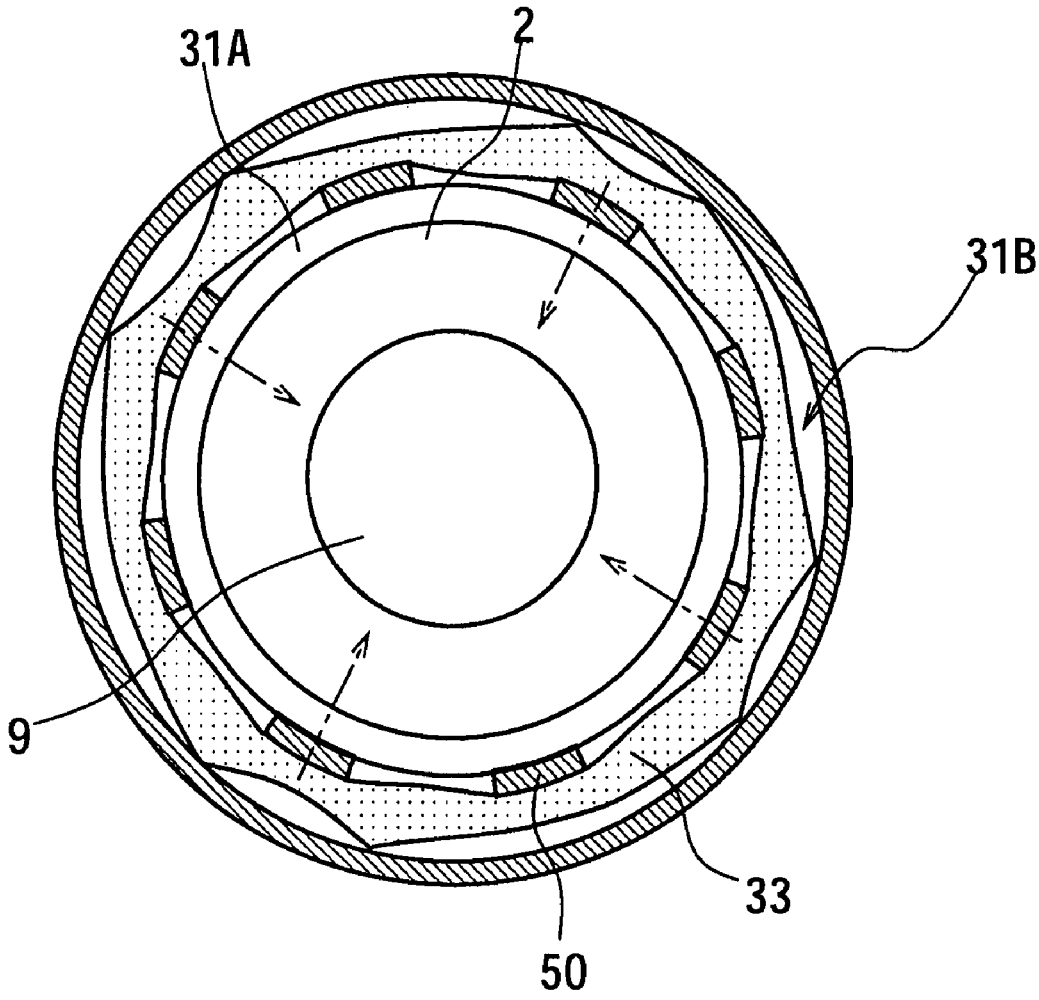
FIG. 8 is a front view showing another embodiment.

Furthermore, the above embodiment has described a case where the groove 31B is formed at the edge of the frame 31 as a gasket holding means for holding the gasket 33 in its deformed state along the edge opening of the frame 31. This invention, however, is not limited to this and a projection can be formed along the edge opening of the frame 31. Alternatively, as shown in FIG. 8, projections 50 are formed around a circuit along the edge opening of the frame 31.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. A cone speaker having a vibratory edge couplable to a frame, the cone speaker comprising:

a gasket formed in a rectangular sheet with a flat opening of a girth of a prescribed length at a center, the rectangular sheet having two long sides and two short sides; and a flame-comprising a gasket holding means formed along an edge opening to hold the gasket and a region configured to hold the vibratory edge, the gasket holding means being separate and spaced from the region configured to hold the vibratory edge, wherein the gasket is deformable whereby the opening deforms from a first opening configuration to a second opening configuration generally corresponding to the edge opening and attachable along the edge opening of the frame; and the gasket holding means of the frame holds the gasket and keeps the gasket deformed so that the opening remains in the second opening configuration wherein the gasket holding means is an annular groove formed at an edge of the frame, and wherein the vibratory edge is held to the frame separately from the gasket.

2. The speaker-according to claim 1, wherein corners between the two long sides and the two short sides are cut off.

3. The speaker-according to claim 1, wherein the opening in the first opening configuration is generally elliptical in shape.

4. A cone speaker having a vibratory edge couplable to a frame, the cone speaker comprising:

a frame having at least one gasket retainer and a region configured to hold the vibratory edge, the gasket retainer defining an outer perimeter and being separate and spaced from the region configured to hold the vibratory edge; and a gasket formed with an opening having a first inner perimeter, said opening having an undefined configuration wherein said first inner perimeter of the opening is less than the outer perimeter and wherein the gasket is deformable such that said opening is expandable to a have a deformed configuration to define a second perimeter whereby said second perimeter approximates the outer perimeter;

wherein the at least one gasket retainer comprises an annular groove formed at an edge of the frame, and wherein the vibratory edge is held to the frame separately from the gasket.

5. The speaker according to claim 4, wherein the gasket is formed in a rectangular sheet having two long sides and two short sides.

6. The speaker according to claim 5, wherein corners between the two long sides and the two short sides are cut off.

7. The speaker according to claim 4, wherein the first inner perimeter of the opening is generally elliptical in shape.

8. A cone speaker having a vibratory edge couplable to a frame, the cone speaker comprising:

a frame having at least one gasket retainer and a region configured to hold the vibratory edge, the gasket retainer defining an outer perimeter and being separate and spaced from the region configured to hold the vibratory edge; and a gasket formed with an opening having a first inner perimeter, said opening having an undeformed configuration wherein said first inner perimeter of the opening is less than the outer perimeter and wherein the gasket is deformable such that said opening is expandable to a have a deformed configuration to define a second perimeter whereby said second perimeter approximates the outer perimeter;

wherein the at least one gasket retainer comprises a plurality of projections formed at an edge of the frame, the plurality of projections separating the gasket retainer from the region configured to hold the vibratory edge, and wherein the vibratory edge is held to the frame separately from the gasket.

9. The speaker according to claim 8, wherein the gasket is formed in a rectangular sheet having two long sides and two short sides.

10. The speaker according to claim 9, wherein corners between the two long sides and the two short sides are cut off.

11. The speaker according to claim 8, wherein the first inner perimeter of the opening is generally elliptical in shape.

12. The speaker according to claim 8, wherein the region configured to hold the vibratory edge comprises an annular projection.

* * * * *